United States Patent [19]

Stenger

[11] 4,194,358

[45] Mar. 25, 1980

[54] DOUBLE ANNULAR COMBUSTOR CONFIGURATION

[75] Inventor: Richard E. Stenger, Cincinnati, Ohio

[73] Assignee: General Electric Company, Cincinnati, Ohio

[21] Appl. No.: 860,933

[22] Filed: Dec. 15, 1977

[51] Int. Cl.[2] ..... F02C 7/22

[52] U.S. Cl. ..... 60/39.06; 60/39.36; 60/747; 60/39.82 P; 60/748

[58] Field of Search ..... 60/39.65, 39.74 R, 39.82 P, 60/39.36, 39.06

[56] References Cited

U.S. PATENT DOCUMENTS

| | | | |
|---|---|---|---|
| 2,996,884 | 8/1961 | Johnson et al. | 60/39.65 |
| 3,788,065 | 1/1974 | Markowski | 60/39.65 |
| 3,910,035 | 10/1975 | Juhasz et al. | 60/39.74 R |
| 3,931,707 | 1/1976 | Vooviak | 60/39.82 P |

OTHER PUBLICATIONS

Yaffee, M., "NASA Seeks Clean Combustors", *Aviation Week and Space Tech.,* Aug. 26, 1974, pp. 56–59.

*Primary Examiner*—Robert E. Garrett

*Attorney, Agent, or Firm*—Dana F. Bigelow; Derek P. Lawrence

[57] ABSTRACT

A double annular combustor is provided with a main stage section disposed on the radially outer side such that its length is thereby minimized to reduce the resulting NOX emissions and its profile is thereby linearized so as to reduce the impingement of hot gases against the combustor wall. The pilot stage section is located radially inward so that its increased length tends to increase the residence time for idle and thereby reduce the hydrocarbon and carbon monoxide emissions.

15 Claims, 4 Drawing Figures

DOUBLE ANNULAR COMBUSTOR CONFIGURATION

BACKGROUND OF THE INVENTION

This invention relates generally to gas turbine engines and, more particularly, to combustion systems relating thereto.

The invention herein described was made in the course of or under a contract, or a subcontract thereunder, with the United States Department of the Air Force.

Recent efforts to reduce emissions in gas turbine engines have brought about the use of staged combustion techniques wherein one burner or set of burners is used for low speed, low temperature conditions such as idle, and another, or additional, burner or burners are used for higher temperature operating conditions. One particular configuration of such a concept is that of the double annular combustor wherein the two stages are located concentrically in a single combustor liner. Conventionally, because of the necessity for having an igniter in the pilot stage, and the relative ease with which it can be installed in the outer liner, the pilot stage section is located concentrically outside and operates under low temperature and low fuel/air ratio conditions during engine idle operation. The main stage section, which is located concentrically inside, is later fueled and cross-ignited from the pilot stage to operate at the high temperature and relatively high fuel/air ratio conditions.

It will be recognized by one skilled in the art that in a double annular combustor, where the height of the dome is always greater than that of the turbine nozzle annulus, the outer section is going to be generally straight and of short length, and the inner section is going to be generally curved and have a longer length. It has been recognized that these structural relationships are disadvantageous for a number of reasons. In regard to emissions, when the engine is operating at idle, the pilot stage is operating with low compressor discharge temperatures and pressures and the reaction rates are thus relatively slow. Accordingly, in order to allow for complete or near-complete combustion to thereby reduce the amount of hydrocarbon and carbon monoxide emissions, it is preferable to have a long residence time, a characteristic which is not inherent in the shorter radially outside pilot section. On the other hand, in the main stage section, where nitrous oxides are the primary emission problem, it is desirable to minimize the residence time so as to also minimize the forming of nitrous oxides. Again, locating of the main stage section on the radially inner side tends to defeat this purpose since this section is necessarily longer than that on the outer side.

Another disadvantage of having the main burner on the radially inner side is that the higher temperature gases emanating from that burner tend to flow against the curved inner liner of the combustor. Thus, it is necessary to provide a high degree of cooling to that liner in order to prevent it from burning through.

A further condition which renders the conventional double annular combustor configuration inadequate is that of the resulting natural profile at the turbine nozzle annulus. Ideally, in order to optimize turbine life, it is desirable to have a profile in which the temperatures are cooler at the inner diameter than at the outer diameter. However, with the main burner located radially inward as described hereinabove, the profile which exists is one having hotter temperatures toward the turbine inner side.

It is therefore an object of the present invention to provide a double annular combustor with reduced emission operating characteristics.

Another object of the present invention is the provision of a double annular combustor with improved structural integrity.

Yet another object of the present invention is the provision in a double annular combustor for minimizing the impingement of hot gases against the liner of the combustor.

Still another object of the present invention is the provision in a double annular combustor for a turbine inlet temperature profile which is cooler on the radially inner side.

Yet another object of the present invention is the provision of a double annular combustor which is economical to manufacture and efficient and effective in use.

These objects and other features and advantages become more readily apparent upon reference to the following description when taken in conjunction with the appended drawings.

SUMMARY OF THE INVENTION

Briefly, in accordance with one aspect of the invention, the relative positions of the pilot and main stage sections of a conventional double annular combustor are reversed, that is the pilot stage is placed in the radially inner portion of the combustor and the main stage section is placed in the radially outer portion thereof. In this way, the effective length of the main stage section is relatively short and the effective length of the pilot stage section is relatively long. Further, the profile of the main stage is straightened so that the hot gases do not impinge against the combustor liner, but, rather, it is the low temperature gases from the pilot stage which impinge against the inner liner of the combustor. Finally, the resulting temperature profile at the turbine inlet exhibits higher temperatures toward the radially outer side.

By another aspect of the invention, an igniter is introduced into the pilot stage section by a tube which projects through the combustor outer casing and extends radially inward to the inner dome. This tube may be either straight or curved and have ceramic insulators placed between the igniter leads and the outer tube.

In the drawings as hereinafter described, a preferred embodiment and modified embodiments are depicted; however, various other modifications and alternate constructions can be made thereto without departing from the true spirit and scope of the invention.

DESCRIPTION OF THE PREFERRED EMBODIMENT

Figure 1:
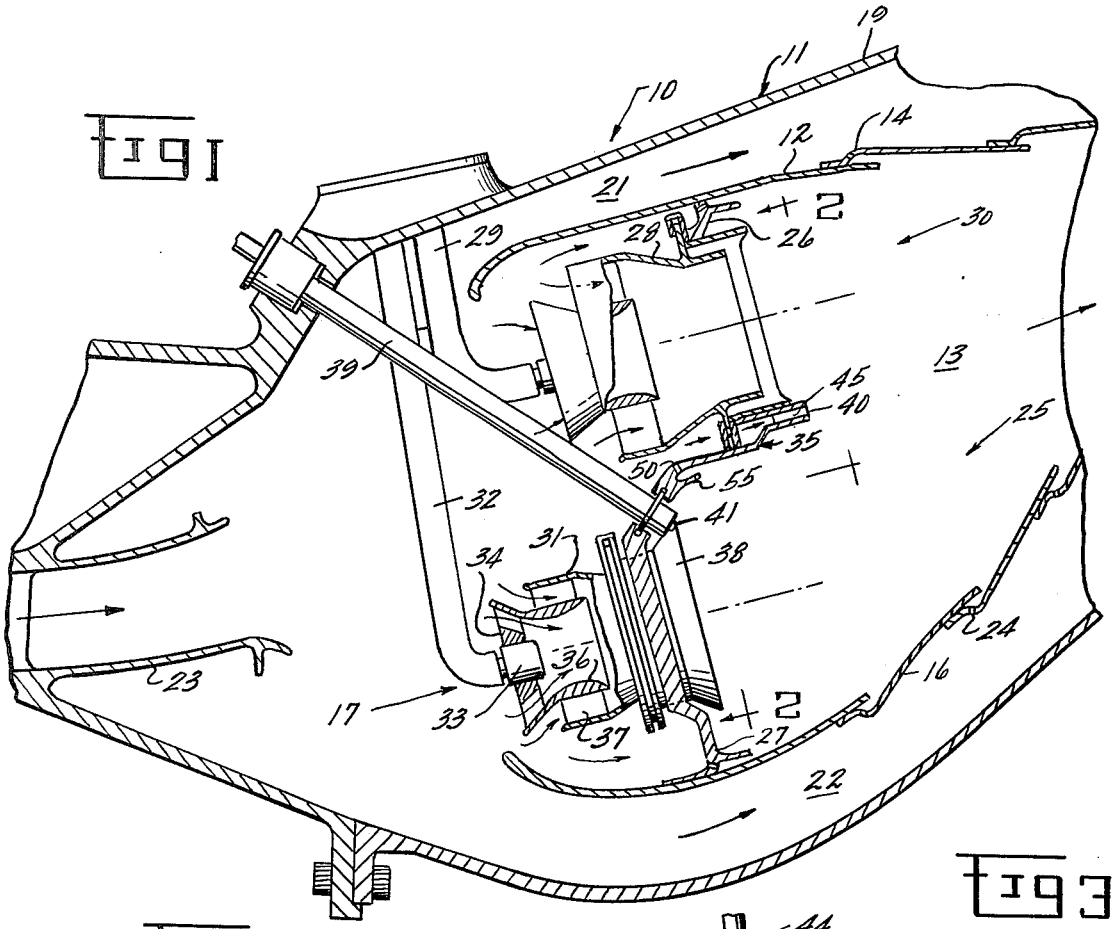
FIG. 1 is an axial cross-sectional view of a double annular combustor in accordance with a preferred embodiment of the invention.
Figure 4:
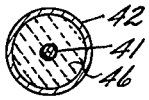
FIG. 4 is a cross-sectional view thereof as seen along line 4—4 of FIG. 3.

Referring to the drawings, and particularly to FIG. 1, the invention is shown generally at 10 as applied to a continuous burning combustion apparatus 11 of the type suitable for use in a gas turbine engine and comprising a hollow body 12 defining a combustion chamber 13 therein. The hollow body 12 is generally annular in form and is comprised of an outer liner 14 and an inner liner 16. At the upstream end of the hollow body 12 is an annular opening 17 for the introduction of air and fuel in a preferred manner as will be described hereinafter.

The hollow body 12 may be enclosed by a suitable shell 19 which, together with the liners 14 and 16, defines passages 21 and 22, respectively, which are adapted to deliver in a downstream flow the pressurized air from a suitable source such as a compressor (not shown) and a diffuser 23. The compressed air from the diffuser 23 passes principally into the annular opening 17 to support combustion and partially to the passages 21 and 22 where it is used to cool the liners 14 and 16 by way of a plurality of apertures 24 and to cool the turbomachinery further downstream.

Disposed between and interconnecting the outer and inner liners 14 and 16, near their upstream ends, are outer and inner domes 26 and 27, respectively, which are attached to the liners by way of brazing or the like. Domes 26 and 27 are arranged in a so-called "double annular" configuration wherein the two form the forward boundaries of separate, radially spaced, annular combustors which act somewhat independently as separate combustors during various staging operations. For purposes of description, these annular combustors will be referred to as the inner annular combustor and outer annular combustor, 25 and 30, respectively, and will be more fully described hereinafter.

Figure 2:
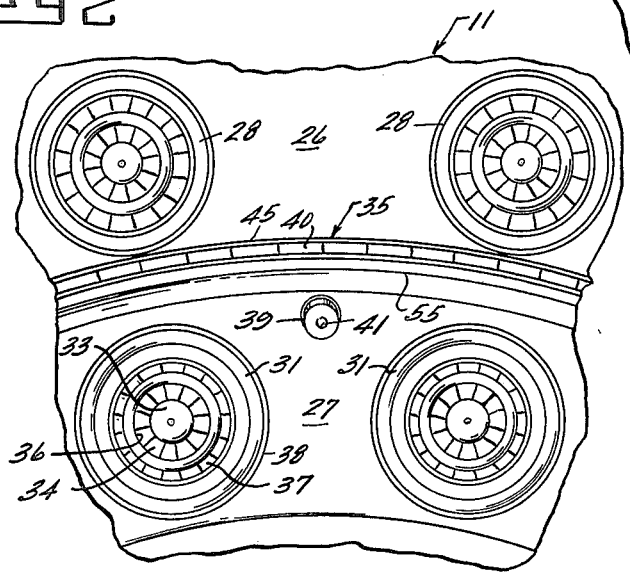
FIG. 2 is a transverse, cross-sectional view thereof as seen along line 2—2 of FIG. 1.

Interconnecting the outer and inner domes 26 and 27 is a centerbody 35 which acts to partially define the common boundary between the inner and outer annular combustors 25 and 30, respectively. As will be seen in FIGS. 1 and 2, this centerbody 35 comprises a plurality of circumferentially spaced alternating slots 40 and ribs 45 which conduct the flow of air rearwardly as shown by the arrow to, in effect, extend the common boundary. That is, along that line of airflow there is a high pressure area that tends to restrain the combustive gases from the inner annular combustor 25 from entering the outer annular combustor and vice versa. The centerbody also includes a plurality of cooling holes 50 and a lip 55 to provide for the flow of cooling air along the surface of the centerbody.

Disposed in the outer dome 26 is a plurality of circumferentially spaced carburetor devices 28 with their axes being coincident with that of the outer annular combustor and aligned substantially with the outer liner 14 to present an annular combustor profile which is substantially straight and short in length. It should be understood that the carburetor device 28 can be of any of various designs which acts to mix or carburet the fuel and air for introduction into the combustion chamber 13. One design might be that shown and described in patent application Ser. No. 644,040, filed Dec. 24, 1975, now U.S. Pat. No. 4,070,826, "Low Pressure Fuel Injection System," Stenger et al, and assigned to the assignee of the present invention. In general, the carburetor device 28 receives fuel from a fuel tube 29 and air from the annular opening 17, and the fuel is atomized by the flow of air as shown by the arrows to present an atomized mist of fuel to the combustion chamber 13.

In a manner similar to the outer dome 26, the inner dome 27 includes a plurality of circumferentially spaced carburetor devices 31 whose axes are aligned substantially parallel to the axis of the carburetor device 28. These carburetor devices 31 together with the inner dome 27, the inner liner 16 and the centerbody define the inner annular combustor 25 which may be operated substantially independently from the outer annular combustor as mentioned hereinbefore. Again, the specific type and structure of the carburetor device 31 is not important to the present invention, but should preferably be optimized for efficiency and low emissions performance. For description purposes only, and except for considerably lower airflow capacity, the carburetor device 31 is identical to the carburetor device 28 and includes a fuel tube 32 and a fuel nozzle 33 for introducing fuel which is atomized by high pressure or introduced in a liquid state at a low pressure. A primary swirler 34 receives air as shown by the arrows to interact with the fuel and swirl it into the venturi 36. A secondary 37 then acts to present a swirl of air in the opposite direction so as to interact with the fuel/air mixture to further atomize the mixture and cause it to flow into the combustion chamber 13. A flared splashplate 38 may be employed at the downstream end of the carburetor device so as to prevent excessive dispersion of the fuel/air mixture.

In order to present an ignition capability to the inner annular combustor 25 an igniter tube 39 passes through the combustor shell 19 and extends radially inward and through the inner dome 27 to have the end of its center electrode 41 in close proximity to the combustor devices 31 on either side thereof. Although the igniter tube 39 is somewhat different from the conventional igniter in that it extends further into the combustor, the center electrode 41 is of the conventional type and operates in a manner well known in the art.

Considering now the operation of the above-described double annular combustor, the inner annular combustor 25 and the outer annular combustor 30 may be used individually or in combination to provide the desired combustion condition. Preferably, the inner annular combustor 25 is used by itself for starting and low speed conditions and will be referred to as the pilot stage. The outer annular combustor 30 is used at higher speed, higher temperature conditions and will be referred to as the main stage combustor. Upon starting the engine and for idle condition operation, the carburetor devices 31 are fueled by way of the fuel tubes 32, and the pilot stage is ignited by way of the center electrode 41. The air from the diffuser 23 will flow as shown by the arrows, both through the active carburetor devices 31 and through inactive carburetor devices 28. During these idle conditions, wherein both the temperatures and airflow are relatively low, the pilot stage operates over a relatively narrow fuel/air ratio band and the inner liner 16, which is in the direct axial line of the carburetor devices 31, will see only narrow excursions in relatively cool temperature levels. This will allow the cooling flow distribution in the apertures 24 to be maintained at a minimum. Further, since the pilot stage is relatively long as compared with the main stage, the residence time will be relatively long to thereby minimize the amount of hydrocarbon and carbon monoxide emissions.

As the engine speed increases, fuel is introduced by the fuel tubes 29 into the carburetor devices 28 so as to activate the main stage. During such higher speed operation, the pilot stage remains in operation but the main stage consumes the majority of the fuel and the air. It will be recognized that because of the linear shape of the main stage, the relatively hotter gases will not impinge on the liner 14 but will flow directly rearward so as to minimize the requirement for cooling air at the liner 14. Further, since the main stage is axially short in length, the residence time will be relatively short to thereby reduce the NOX emissions.

It will be recognized that such a reverse relationship with respect to the pilot main stages will also bring about a favorable profile at the turbine. That is, at idle conditions, the radially inner side of the turbine will be hotter but these exhaust gases will still be relatively cool. At the higher speed operating conditions, the profile at the turbine will be one with relatively cooler temperatures at the radially inner side and the hotter gas temperatures from the main stage will be on the radially outer side. This, of course, is the desired profile for bringing about longer life characteristics in the turbine.

Figure 3:
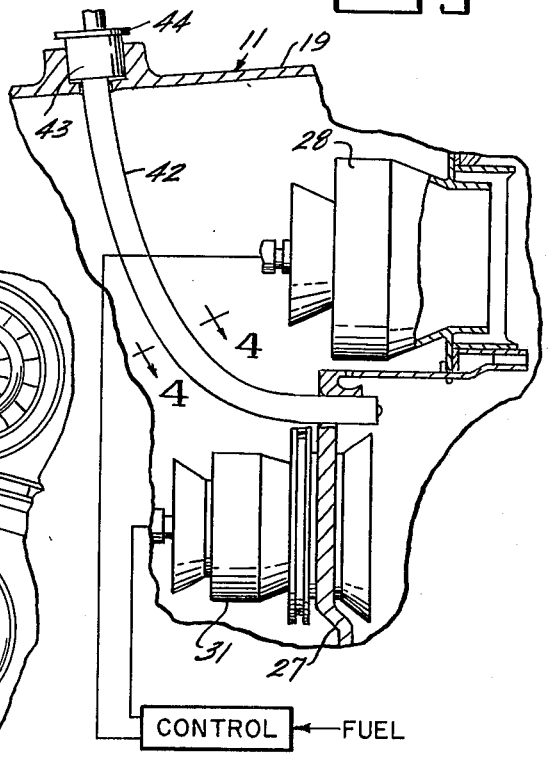
FIG. 3 is a partial cross-sectional view of a combustor with a modified embodiment of the present invention incorporated therein.

In order to accommodate this reverse position with respect to the main pilot stage, as compared with the conventional double annular combustor, it is required to have an igniter which extends all the way into the inner annulus rather than only the short distance to the outer annulus. The use of a linear tube 39 extending through the casing 11 down to and through the inner dome 27 is one way of accomplishing this requirement. An alternative embodiment is shown in FIG. 3 and comprises a curved igniter tube 42 which projects through the casing 11 and curves downwardly to eventually pass through the inner dome 27 in a substantially normal relationship. The curved tube 42 is secured in the casing 11 in a manner similar to the linear tube 39, that is, with a threaded insert 43 having a wrenching flat 44 attached thereto. In choosing between the linear igniter tube 39 and the curved fuel tube 42, one of the primary considerations would be the location of the threaded insert 43. With the use of the linear igniter tube 39, the location choices for the threaded insert 43 are relatively few, but with the use of the curved fuel tube 42, a greater number of locations are available. Although with either of the tubes an insulator 46 of a ceramic material or the like is desirable to isolate the outer electrode or tube 42 from the center electrode 41, they are more important in the case of the curved fuel tube 42. In fact, a greater number of the donut-shaped ceramic discs would be required for the curved tube. In such case, the discs are first placed within the tube and then the tube is swaged to improve the insulating properties of the combination.

It will be understood that the present invention has been described in terms of particular embodiments, but may take on any number of other forms while remaining within the scope and intent of the invention. For example, it will be recognized that the present invention would be applicable to any number of variations and combinations of carburetor devices. That is, although the outer carburetor devices 28 and inner carburetor devices 31 are shown to be equal in number and radially aligned, the numbers and/or locations of either of these sets could be varied. Also, it will be recognized that the relative axial locations thereof as seen in FIG. 1 could be varied.

Having thus described the invention, what is claimed as novel and desired to be secured by Letters Patent of the United States is:

1. An improved double annular combustor of the type having concentrically disposed pilot and main stage sections, wherein the pilot stage section has inner combustor domes and means for fueling said inner combustor domes for lower power operation and the main stage section has outer combustor domes and means for fueling said outer combustor domes only for higher power operation, said pilot stage section being disposed radially inward of the main stage section.

2. An improved double annular combustor as set forth in claim 1 wherein the length of the pilot stage section is greater than that of the main stage section.

3. An improved double annular combustor as set forth in claim 1 and including an igniter which extends radially inward to the pilot stage section.

4. An improved double annular combustor as set forth in claim 1 wherein the pilot stage section includes an annular dome and said igniter extends through said annular dome.

5. An improved double annular combustor as set forth in claim 1 wherein the main stage section includes a combustor dome whose extended axis does not intersect the wall of the main stage combustor section.

6. An improved double annular combustor as set forth in claim 1 wherein the pilot stage section includes a combustor dome whose extended axis intersects the wall of the pilot stage combustor section.

7. An improved double annular combustor of the type having concentrically disposed outer and inner combustor domes wherein the improvement comprises means for activating the combustor domes in stages with the radially inner combustor dome being fueled for idle operation and the radially outer combustor dome being activated for higher temperature operating conditions.

8. An improved double annular combustor as set forth in claim 7 wherein each of the outer and inner combustor domes include a plurality of circumferentially spaced carburetion devices.

9. An improved double annular combustor as set forth in claim 7 and including an igniter which extends radially inward to the inner combustor dome.

10. An improved double annular combustor as set forth in claim 8 and including an igniter which extends radially inward to the inner combustor dome and is disposed between a pair of adjacent carburetion devices.

11. An improved double annular combustor as set forth in claim 7 and including an outer liner which is generally linear in form and aligned substantially with the axes of said outer combustor dome.

12. An improved double annular combustor as set forth in claim 7 and including an inner liner which is substantially curved in axial cross section and aligned so as to intersect with the axes of said inner combustor dome.

13. An improved double annular combustor as set forth in claim 7 and including a centerbody disposed between said radially inner and outer combustor domes.

14. An improved method of staging a double annular combustor of the type having concentrically disposed inner and outer combustor domes comprising the steps of:

(a) providing fuel and ignition to the radially inner combustor domes during periods of idle operation; and (b) providing fuel to the outer combustor domes for engine operation at speeds above engine idle operation.

15. An improved method as set forth in claim 14 and including the additional step of providing a greater amount of airflow through the outer combustor dome than through the inner combustor dome.

* * * * *